US006843192B1

(12) United States Patent
Nugteren et al.

(10) Patent No.: US 6,843,192 B1
(45) Date of Patent: Jan. 18, 2005

(54) PERSONAL WATERCRAFT HAVING A PREFORMED RUB RAIL

(75) Inventors: Dan Nugteren, Spirit Lake, IA (US); John Thompson, Spirit Lake, IA (US)

(73) Assignee: Polaris Industries Inc., Medina, MN (US)

( * ) Notice: Subject to any disclaimer, the term of this patent is extended or adjusted under 35 U.S.C. 154(b) by 0 days.

(21) Appl. No.: 10/422,348

(22) Filed: Apr. 24, 2003

(51) Int. Cl.[7] ..... B63B 35/73
(52) U.S. Cl. ..... 114/55.5; 293/126
(58) Field of Search ..... 114/55.5, 219; 293/1, 126, 127, 128

(56) References Cited

U.S. PATENT DOCUMENTS

| | | | | |
|---|---|---|---|---|
| 2,910,033 | A | 10/1959 | Weisberg | |
| 2,959,146 | A | 11/1960 | Erkert | |
| 2,990,802 | A | 7/1961 | Ong et al. | |
| 3,065,724 | A | 11/1962 | Tritt | |
| 4,084,533 | A | 4/1978 | Boyer | 114/219 |
| 5,096,753 | A | 3/1992 | McCue et al. | 428/31 |
| 5,149,569 | A | 9/1992 | McCue | 428/31 |
| 5,730,077 | A | 3/1998 | Nunes et al. | 114/219 |
| 5,743,204 | A | 4/1998 | Tweet | 114/219 |
| 5,829,378 | A | 11/1998 | Nunes et al. | 114/219 |
| 6,349,662 | B1 | 2/2002 | Limansky et al. | 114/219 |

OTHER PUBLICATIONS

Taco Metals Catalog, pp10–13.

*Primary Examiner*—Jesus D. Sotelo
(74) *Attorney, Agent, or Firm*—Fredrikson & Byron, P.A.

(57) ABSTRACT

Personal watercraft having extruded rigid rub rails that can be curved in vertical and horizontal dimensions to provide complex geometries in watercraft. One rub rail has a pair of resilient opposed converging wings extending outwardly from the rub rail to form an open channel along the rub rail length. A first bottom lip can extend inwardly to hug the downwardly facing surface of the top deck. A second lip can curve upward and inward beneath the first inwardly extending bottom lip. The second lip can provide an increased ability to hug sharp horizontally curved corners of the watercraft without wrinkling, for example, the rear corners of the watercraft. The rub rail can be both vertically and horizontally curved in the same region and be affixed to a vertical bond flange. In some personal watercraft, the rub rail is formed of a rigid material having a Shore A hardness of at least about 90. The complex geometries of some rub rails are created by heating the rub rail, securing the rub rail to a forming jig or fixture, and allowing the rub rail to cool. The cooled rub rail can thus have the preformed, complex geometry of the top deck to which it is to be affixed, while having a transverse profile than cannot be made by injection molding.

27 Claims, 8 Drawing Sheets

PERSONAL WATERCRAFT HAVING A PREFORMED RUB RAIL

FIELD OF THE INVENTION

The present invention is related generally to personal watercraft. More specifically, the present invention is related to rub rails on personal watercraft.

BACKGROUND OF THE INVENTION

Personal watercraft (PWC) have become increasingly popular in recent years. A personal watercraft, also known as a "jet ski" typically has a bottom hull, handle bars for steering, a tunnel within the bottom hull, a jet pump located within the bottom tunnel, and an engine within the hull under the top deck for driving the jet pump. The jet pump typically pulls in water from the front of the tunnel under the boat, and discharges the water at high velocity through a steerable nozzle at the rear of the boat. The handlebars are typically coupled to the nozzle, which is the steering mechanism for the personal watercraft. The watercraft commonly has a straddle-type seat and foot wells disposed on either side of the seat.

Personal watercraft typically have a top deck affixed to a bottom hull. The PWC has a shroud mounted in front of the driver on top of the top deck to house the steering column and some instruments. A front portion of the top deck includes a hinged cover or "hood." The underside of the hood can include a gasket or a grommet that attempts to provide a watertight seal between the hood and the top deck. The hood typically covers either a storage bin or an engine access port.

Personal watercraft often have a "rub rail" that can serve as a bumper around the boat. The rub rail can be wrapped around the outer extent of the top deck, to protect the top deck from damage from other boats or docks alongside. Rub rails ideally have some give or resiliency. This resiliency can be provided with a complex lateral or transverse profile. Some such rub rails have an outer wall over a central channel, or a pair of cantilevered wings that provide the resiliency. Rub rails are generally formed using one of two methods. Extrusion can be used to form straight sections of rub rail. A die for the extrusion process can cost on the order of 10,000 dollars, or less. Where straight sections of rub rail are not appropriate, injection molding can be used to form complex curves and rear corner pieces. Injection molds can cost on the order of 100,000 or 200,000 dollars, depending on the complexity. Injection molds cannot easily be used to form certain lateral or transverse shapes. In particular, injection molding cannot easily be used to form a profile that cannot be pulled from the mold, for example, profiles having a central channel or converging cantilevered wings.

Personal watercraft typically have an outer periphery or bow line. This periphery can be formed by the coming together and bonding of the bottom hull to the top deck. Some personal watercraft have a "horizontal bond line", resulting from the top deck and bottom hull extending horizontally and outwardly together over a horizontal segment in which the top deck and bottom hull are bonded together. A rub rail to protect and cover this horizontal bond line can function as a cap, having an upper lip extending over the top deck to support the rub rail and hold it in place. Such a rub rail can have a bottom lip extending under the bottom hull segment as well.

Other watercraft have a "vertical bond line", resulting from the top deck extending downward to terminate in a vertically downward segment. The bottom hull can extend upward to form the hull along the waterline, then extend further upward, then outward in an upside down "U" shape, then downward to terminate in a vertically downward segment alongside and inside of the outer top deck vertically downward segment. The vertically downward segments of the top deck and bottom hull are said to form the vertical bond line.

The vertical bond line typically has a top deck outer vertical surface on which to mount the rub rail. Most vertical bond lines do not provide an upper ridge on which to hang or support the rub rail. The rub rail is typically secured with fasteners of some sort. Rub rails secured to vertical bond flanges are usually, if not always, formed of a rigid material. Forming such a rub rail out of a flexible or even a semi-rigid material can lead to a very soft rub rail after the rub rail has been in direct sunlight for a period of time. If hot and soft enough, the rub rail can even be pulled from and over the fasteners, away from the watercraft. For this reason, rub rails for vertical bond flanges are typically made from rigid polymers, to avoid this tearing and to avoid sagging of the rub rail.

Rigid rub rails can present a problem in that they do not conform to complex surface geometries as easily as semi-rigid or flexible. In particular, vertically curved or bow lines have been difficult to protect with rigid rub rails. Also, rear corners have been difficult to protect with rigid rub rails. One solution has been to make the rub rails for complex curves or corner pieces using injection molding. Injection molding suffers from the cost disadvantage discussed above. Injection molding also can limit the rub rail to shapes that have limited resiliency. Finally, the discrete rear corner pieces formed by injection molding can form a gap or discontinuity where they meet the side rub rail pieces and can be snagged as the discontinuity catches on docks, even pulling the rub rail away from the watercraft. A continuous extrusion could be used that wraps around the rear corners, but current rub rails, if flexible enough to wrap around the rear corners, tend to both wrinkle and to sag on the vertical bond flange.

What would be desirable are watercraft designs that do not require separate rear corner pieces. What would also be desirable are rub rails that are rigid enough to be used on vertical bond flanges without sagging, can be formed using extrusion, and can wrap around rear corners and protect personal watercraft hulls over vertical curves.

SUMMARY OF THE INVENTION

The present invention provides a jet propelled personal watercraft including a hull, the hull having a bottom hull and a top deck secured over the bottom hull, the hull defining an engine compartment sized to contain an internal combustion engine for powering a jet propulsion unit. The personal watercraft also includes a jet propulsion unit including a steerable water discharge nozzle. The top deck can have a raised, longitudinally extending seat adapted to accommodate an operator in straddle fashion. The top deck can have a downwardly extending portion about the watercraft periphery terminating in a bottom edge.

A polymeric rub rail including a vertical portion can be secured to the top deck downwardly extending portion and have an inwardly extending lip disposed beneath the top deck bottom edge, and further have a bottom lip curved upward and inward from the rub rail toward the bottom hull. Some rub rails have a first wing extending downwardly from the rub rail vertical portion and a second wing extending upwardly from the rub rail vertical portion to form an open channel between the wings and the vertical portion. The converging wings can provide resiliency to the rub rail. In some watercraft, the rub rail is formed of a polymeric material having a Shore A hardness of at least about 90. In other watercraft, the rub rail is formed of a polymeric material having a Shore A hardness of at least about 95. The rub rail can be secured to the top deck over a region having a vertical radius of curvature of less than about 20, 15, or 10 inches, depending on the embodiment.

Some personal watercraft have two, opposite rear corners, wherein the rub rail wraps continuously around at least one of the corners. The rub rail wraps continuously around both rear corners in other personal watercraft, and includes a first corner piece wrapping continuously around a first corner and a second corner piece wrapping continuously around the second corner in still other personal watercraft. The corners can have a radius of curvature of less than 2 feet or 1 foot, in various embodiments. Some watercraft have a rub rail with a vertically curved region. The vertical curve can have a radius of curvature of less then about 20 inches, or even less than 10 inches.

The invention includes methods for securing a polymeric rub rail about a personal watercraft top deck periphery. One method includes providing the personal watercraft, the watercraft having a vertically curved portion of a top deck periphery having a substantially downwardly oriented outer face, and also providing the rub rail, the rub rail having a vertical region for securing to the top deck downwardly oriented outer face. A forming jig can be provided, the jig including substantially the same geometry as the vertically curved personal watercraft top deck section. The rub rail can be heated, then forced to conform to the jig, then allowed to cool, and freed from the jig. The pre-formed rub rail can be secured to the watercraft top deck downwardly extending face. The rub rail can be formed from a rigid material, having a Shore A hardness of at least about 90 or 95, and/or a tensile modulus of at least about 2 GPa.

In some methods, the rub rail has a pair of substantially opposed wings extending outwardly from the rub vertical region and toward each other to form an open channel between the wings and the vertical region. The method can further include inserting a mandrel into the cavity between the wings and the vertical region such that the cavity does not become closed during heating. The heating can be to a temperature of about or above the heat deflection temperature of the polymer in some methods.

The invention can include a rub rail for use on a personal watercraft, the rub rail having a longitudinal dimension, a vertical dimension, and a lateral dimension transverse to the longitudinal and vertical dimensions. The rub rail can have an inward lateral direction to be disposed toward the watercraft and an outward lateral direction to be disposed away from the watercraft. The rub rail can further include a vertical section including an inwardly facing surface for disposition against a personal watercraft peripheral surface, the vertical section having a longitudinally extending mid-region dividing the rub rail into a top region and a bottom region. A first wing can extend outwardly and vertically from the rub rail vertical section. The rub rail can be an extruded rub rail having a Shore A hardness of at least about 90 or 95 and can have a curve along the longitudinal dimension. The curve along the longitudinal dimension can include a vertical curve, a horizontal curve, or a simultaneous vertical and horizontal curve.

The rub rail first wing can extend outwardly and downwardly from the vertical section, and the rub rail can further have a second wing extending outwardly and upwardly from the rub rail vertical section. The rub rail can also have a first lip extending inwardly from the vertical section and a second lip curving upwardly and inwardly from the vertical section.

The present invention includes another rub rail for mounting on a personal watercraft, the rub rail having a longitudinal dimension, a vertical dimension, a lateral dimension transverse to the longitudinal and vertical dimensions, an inward lateral direction to be toward the watercraft, and an outward lateral direction to be away from the watercraft. The rub rail can have a transverse, cross-sectional profile that cannot be made using injection molding, with the rub rail being formed from a rigid material having a tensile modulus of at least about 2.5 GPa and a curve along the longitudinal dimension. The curve can include a vertical curve, a horizontal curve, or both a vertical and horizontal curve.

The present invention provides a method for attaching a rub rail to a personal watercraft, the method including providing a rub rail formed from a rigid material having a tensile modulus of at least about 2.5 GPa and having a transverse profile that cannot be made using injection molding, and also providing a personal watercraft having a substantially vertical peripheral curved surface. The rub rail can be formed to have a rub rail curve substantially matching the watercraft surface curve, such that the rub rail maintains the curve when unconstrained. The pre-formed rub rail can be secured to the watercraft surface. The method can use a rub rail made by extrusion. The method can include providing a forming jig having a jig surface substantially matching the personal watercraft curved surface, wherein the forming includes heating the rub rail, then forcing the rub rail against the jig surface, then cooling the rub rail.

DETAILED DESCRIPTION OF THE PREFERRED EMBODIMENTS

Figure 1:
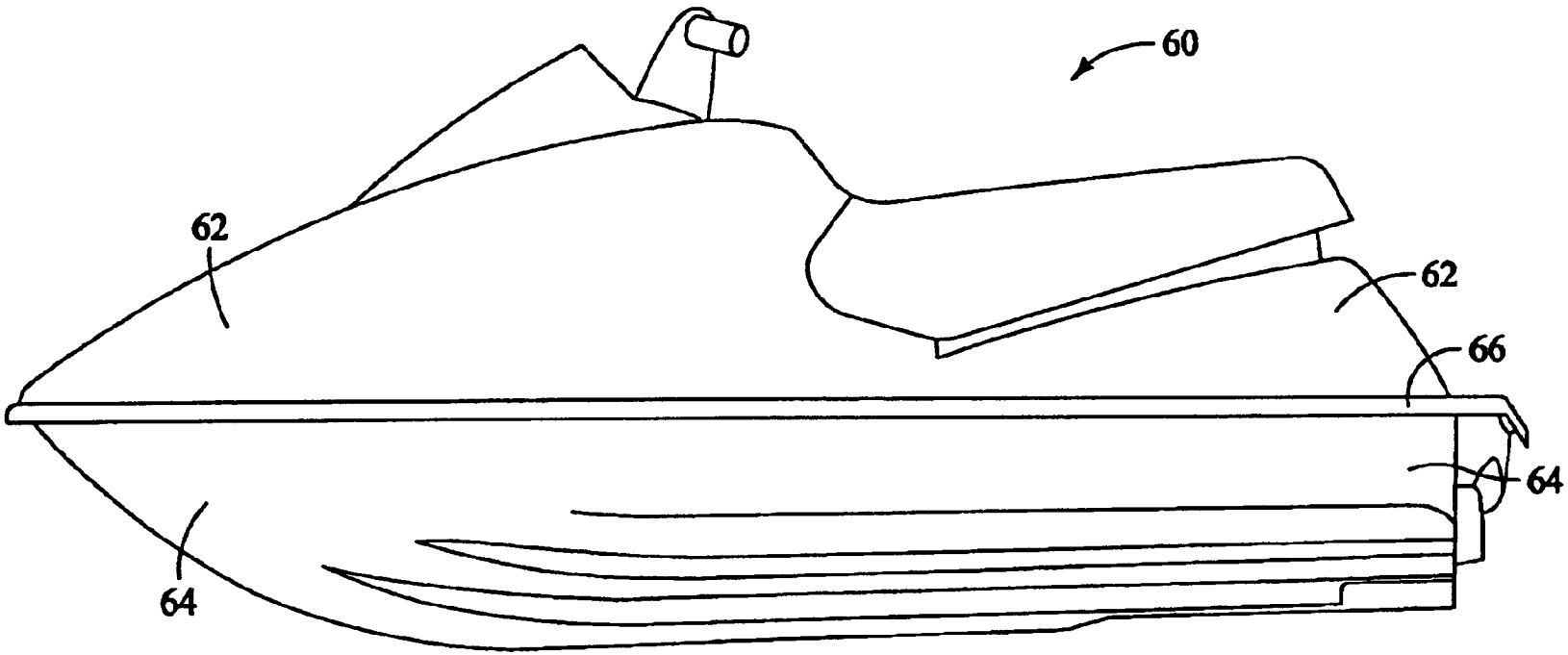
FIG. 1 PRIOR ART
FIG. 1 is a side view of a prior art personal watercraft having a vertically straight or uncurved rub rail.

The following detailed description should be read with reference to the drawings, in which like elements in different drawings are numbered identically. The drawings, which are not necessarily to scale, depict selected embodiments and are not intended to limit the scope of the invention. Several forms of invention will be shown and described, and other forms will now be apparent to those skilled in art. It will be understood that the embodiments shown in the drawings and described below are merely for illustrative purposes, and are not intended to limit the scope of the invention as defined in the claims that follow.

FIG. 1 illustrates a prior art personal watercraft 60 having generally a top deck 62, a bottom hull 64, and a substantially, vertically straight side rub rail 66. While the rub rail of personal watercraft 60 may wrap around shallow, horizontal curves of the top deck, little vertical curvature is seen.

Figure 2:
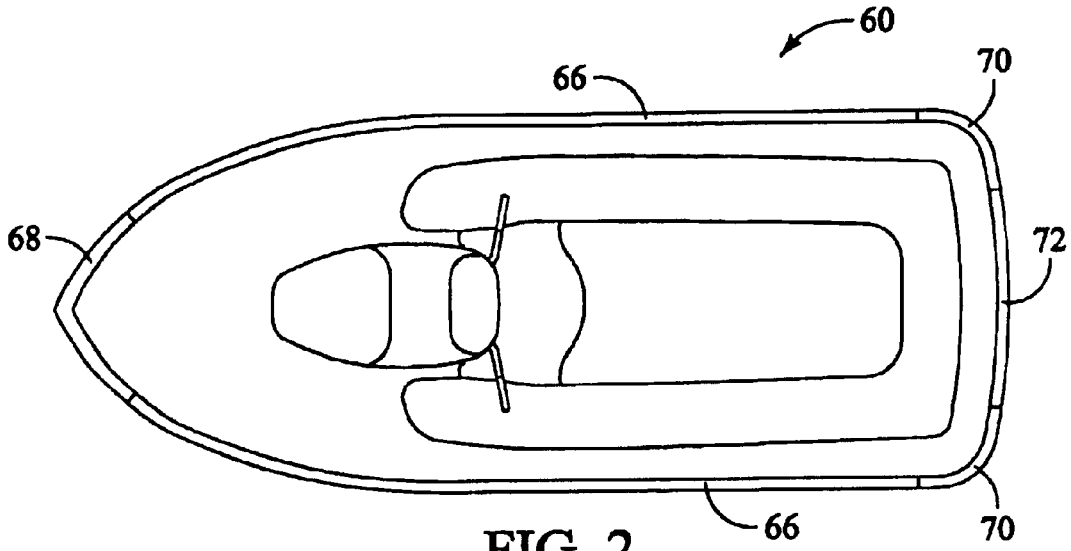
FIG. 2 PRIOR ART
FIG. 2 is a top view of a prior art personal watercraft having a discrete front bumper and two discrete injection molded rear corner pieces.

FIG. 2 illustrates personal watercraft 60 of FIG. 1 from the top. Personal watercraft 60 may be seen to include a front bumper 68, and two, rear, injection molded corner pieces 70. A rear rub rail portion 72 may also be seen. This prior art extruded rub rail, being limited in the ability to wrap around and stay adhered to the watercraft over sharp corners, requires separate injection molded rear corner pieces 70 as illustrated in FIG. 2. Rigid, injection molded front bumper 68 is required as the rub rail is not able to be wrapped around the sharp bow.

Figure 3:
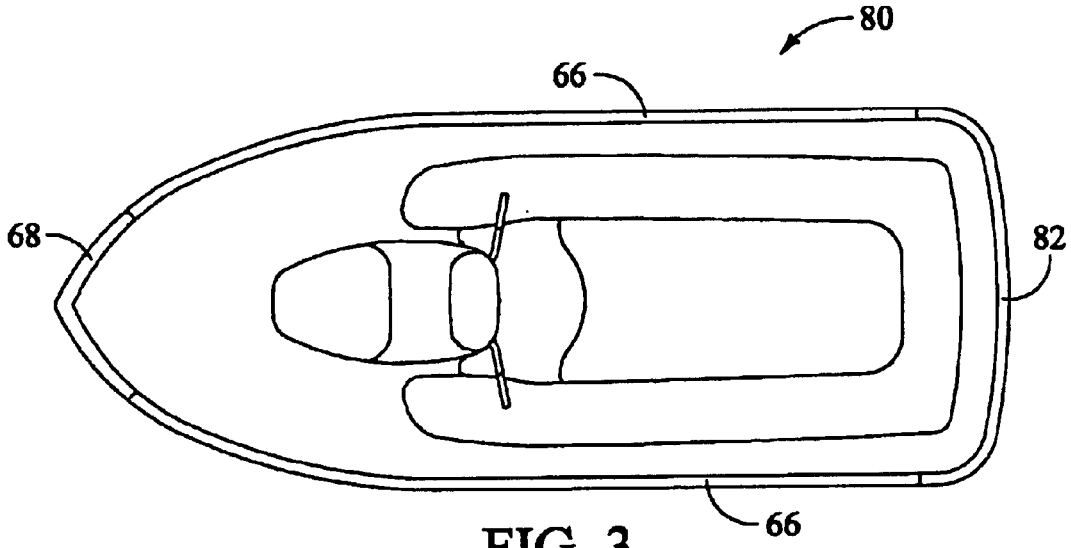
FIG. 3 PRIOR ART
FIG. 3 illustrates a top view of a prior art personal watercraft having a discrete injection molded front bumper and a discrete injection molded rear bumper wrapping around both rear corners.

FIG. 3 illustrates yet another prior art personal watercraft 80 having the side rub rail pieces 66 as previously discussed with respect to FIG. 2, and the separate front bumper 68 also discussed with respect to FIG. 2. Personal watercraft 80 includes a single, separate, injection molded rear bumper 82 extending around both rear corners and the middle rear of the watercraft.

Figure 4:
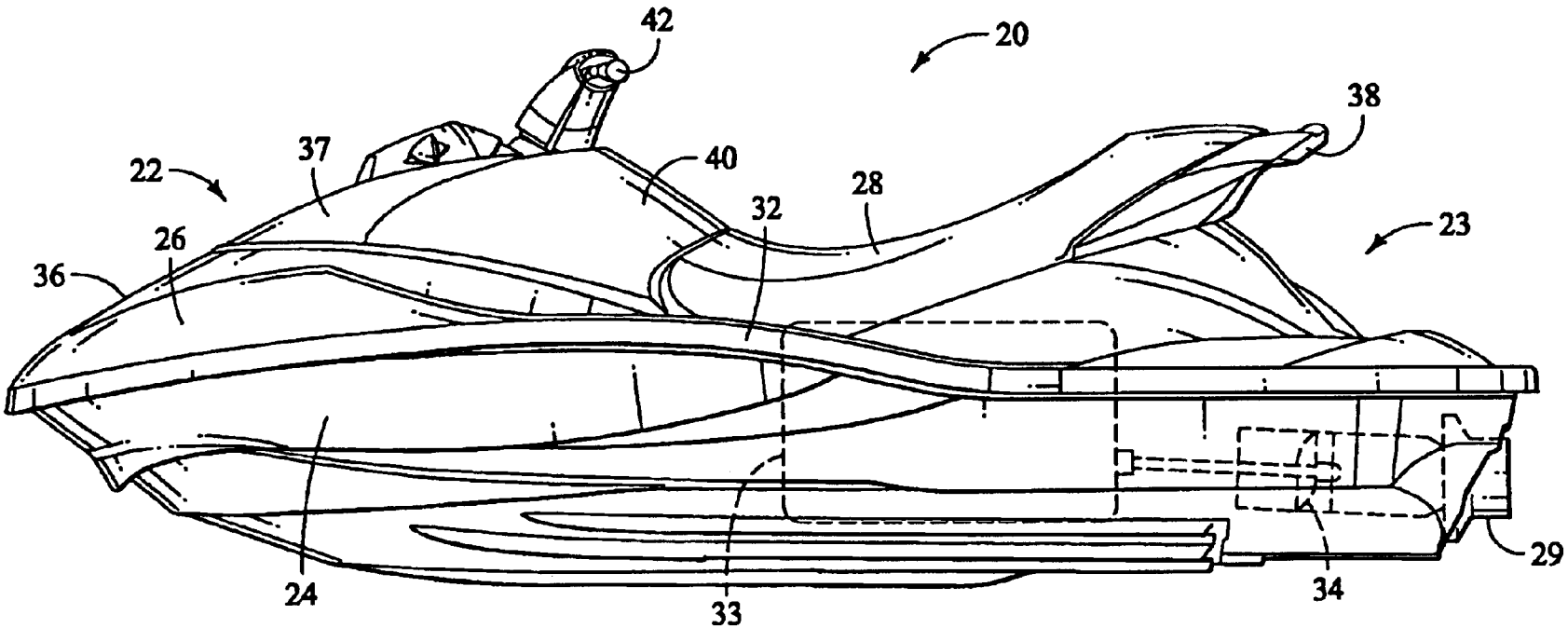
FIG. 4 is a side view of a personal watercraft having a vertically curved, extruded rub rail.

FIG. 4 illustrates a personal watercraft 20 having generally a front or bow 22 and a rear or stern 23. Personal watercraft 20 includes a top deck 26 secured to a bottom hull 24 along an overlapping vertical bond flange portion covered with a rub rail 32 in the embodiment illustrated, forming a hull. Rub rail 32 is preferably extruded, rigid, and has resilient wings. A hood 37 may also be seen, joined to top deck 26 at a hinged front hood portion 36. The hull formed by the bottom hull 24 and top deck 26 define a compartment sized to contain an internal combustion engine 33 for powering the watercraft, and may also include one or more storage compartments, depending upon the size and configuration of the watercraft. The deck portion 26 also has a raised, longitudinally extending seat 28 adapted to accommodate one or more riders seated in straddle fashion on the seat 28. A grab handle 38 is disposed transversely across the rear of the seat. Engine 33 powers a jet propulsion unit 34, typically mounted in a tunnel at the bottom rear portion of the watercraft, all shown in phantom in FIG. 4. Jet propulsion unit 34 includes a steerable water discharge nozzle 29 that is operatively connected to a set of handlebars 42 to facilitate steering of the watercraft by the operator. Handlebars 42 typically mount through a top portion of a shroud 40. The connection between handlebars 42 and discharge nozzle 29 may be of any suitable type, and typically includes mechanical linkages including a control cable. If desired, an electronic connection could also be utilized.

Figure 5:
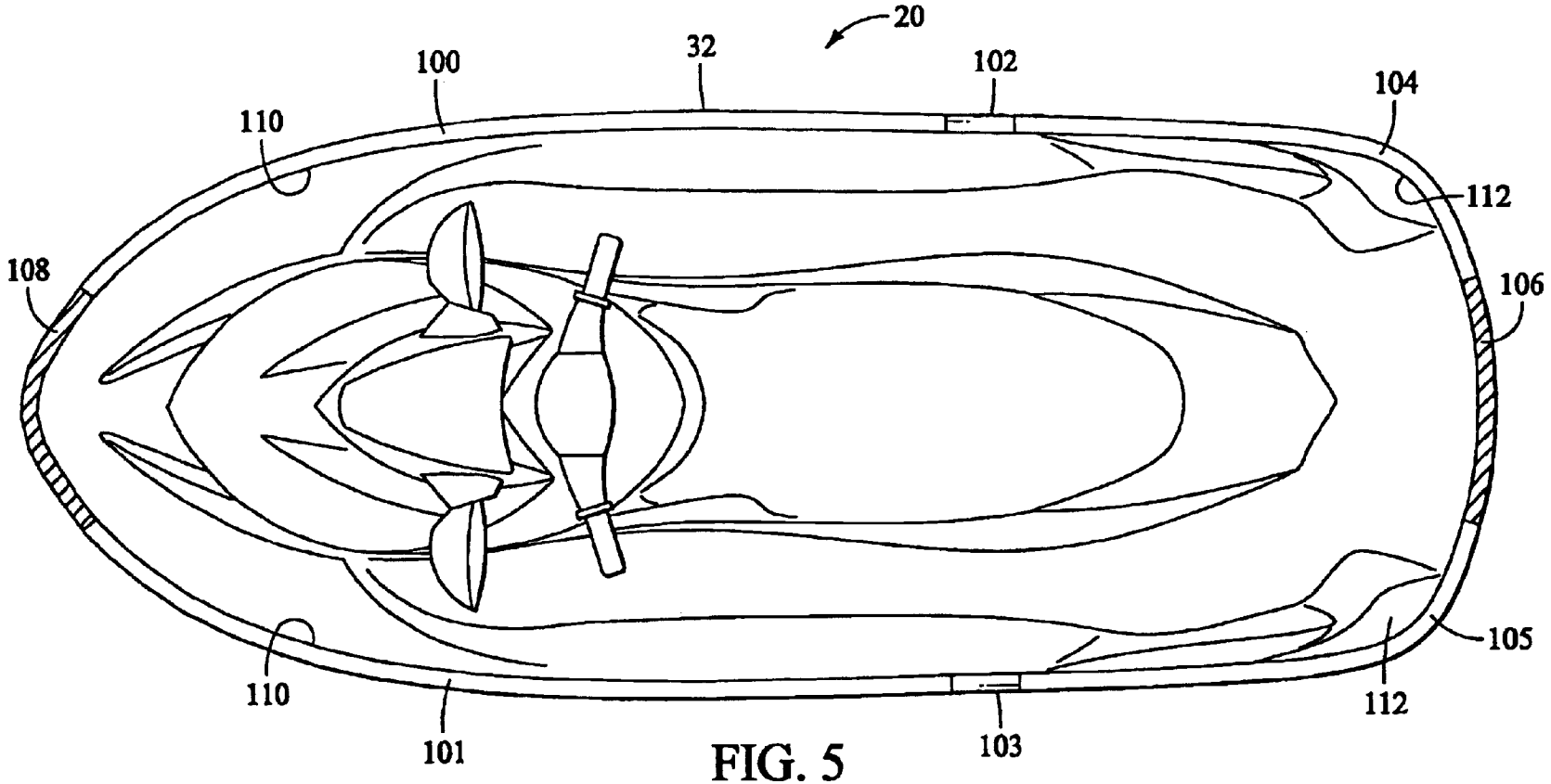
FIG. 5 is a top view of the personal watercraft of FIG. 4, having the rub rail wrapped around both rear corners and having a discrete front bumper, two optional side pieces, and a rear middle bumper.

FIG. 5 illustrates personal watercraft 20 from a top view. Rub rail 32 may now be described in greater detail. Personal watercraft 20 may be seen to have a front bumper 108 wrapped about the bow. To the rear of bumper 108 are two rub rail sections 100 and 101, both being wrapped about the horizontal curved portions indicated at 110. In one embodiment, rub rail portions 100 and 101 continue seamlessly rearward to rear bumper 106, having decorative caps 102 and 103 disposed over the rub rails. In another embodiment, rub rail portions 100 and 101 continue rearward to terminate at discrete side pieces 102 and 103, on either side of the watercraft. Extending rearward of side pieces 102 and 103 are rub rail portions 104 and 105, on either side of the personal watercraft. Rub rail portions 104 and 105 extend rearwardly around the rear corners of the watercraft. In another embodiment, rubrail portions 100 and 101 are formed as a single piece, extending as a single piece rearward from portion 100, then through portions 104, 106, 105, and 101. In yet another embodiment, a single rub rail piece extends rearward from 102, through portions 104, 106, and 105, to terminate forwardly at 103.

A single, rigid, rear center bumper 106 can extend between rub rail corner portions 104 and 105. The horizontal radius of curvature in the watercraft rear is indicated at 112. As can be seen from inspection of FIG. 5, rub rail rear corner portions 104 and 105 are able to hug the top deck around the sharply turning rear outer craft corners.

Figure 6:
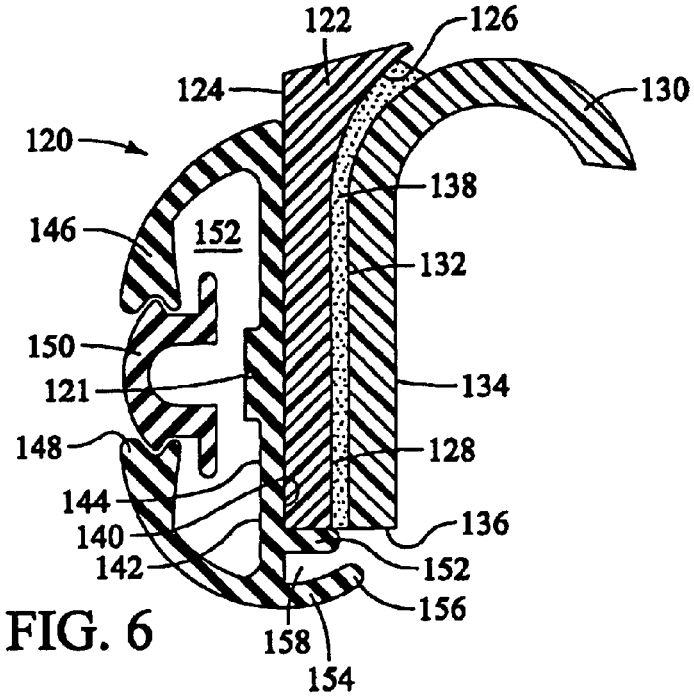
FIG. 6 is a fragmentary, transverse, cross-sectional view of the personal watercraft rub rail of FIG. 4, having a rub rail insert disposed therein, having the rub rail secured to the top deck which is in turn secured to the bottom hull along a vertical bond flange.

FIG. 6 illustrates a rub rail section 120, from a transverse or lateral, cross-sectional view. In FIG. 6, a longitudinal dimension extends into the paper, a transverse or lateral dimension extends (inwardly) right to left, and a vertical dimension extends top to bottom. Rub rail 120 is disposed against a downwardly extending top deck portion 122, which is in turn disposed against a downwardly extending bottom hull portion 130 along a vertical bond flange. Top deck 122 is adhered to bottom hull 130 with adhesive, indicated at 138. Rub rail 120 includes a substantially planar, vertical back region or section 142. Rub rail vertical region 142 includes an inward surface 140 and an outward surface 144. Rub rail 120 further includes a first wing 146 extending outwardly and downwardly from rub rail vertical section 142. Rub rail 120 also includes a second wing 148 extending outwardly and upwardly from rub rail vertical section 142. First wing 146, second wing 148, and rub rail vertical section 142 form an open channel or cavity 152 therebetween. First wing 146 and second wing 148 also form a central longitudinal opening, occupied by a center insert 150 in FIG. 6.

Top deck 122 includes an outwardly facing surface or face 124, an inwardly facing surface or face 126, and a downwardly facing surface or edge 128. Inwardly facing and outwardly facing surfaces 124 and 126 are substantially downwardly extending, as can be seen from inspection of FIG. 6. Bottom hull 130 includes an outwardly facing surface or face 132, an inwardly facing surface or face 134, and a downwardly facing surface, face, or edge 136. Top deck 122 may be seen to terminate downwardly in bottom edge 128. Rub rail 120 may be seen to have an inwardly extending lower lip 152 extending inwardly from rub rail vertical portion 142. Inwardly extending lip 152 has an upper surface that, in some embodiments, can fit closely to top deck downwardly facing edge 128. Rub rail 120 may also be seen to have a center longitudinal strip portion 121 that can be used to secure rub rail 120 to top deck 122 using fasteners. Center strip portion 121 can effectively divide rub rail 120 into a top longitudinal region and a bottom longitudinal region.

Rub rail 120 may also be seen to have a bottom, inwardly and upwardly curved lip 154. Lip 154 terminates in an upwardly and inwardly extending, terminating ridge 156. An inwardly facing channel 158 may be seen formed between upwardly and inwardly curved or curled section 154 and inwardly extending rib 152. Applicants were surprised to discover that the inwardly and upwardly curved rib 154 provided an increased ability for rub rail 120 to hug top deck 122 around sharp corners. In particular, bottom curled rib 154 allowed rub rail 120 to hug top deck 122 around the rather sharp turning rear corners without wrinkling the major outward surfaces of the rub rail. Any wrinkling is forced toward lip 154. It may be seen from inspection of FIG. 6 that rub rail bottom ridge 156 does not contact either the top deck or the bottom hull, as both top deck 122 and bottom hull 130 have terminated their downward extent locally, well above of curved rub rail region 154.

Figure 7:
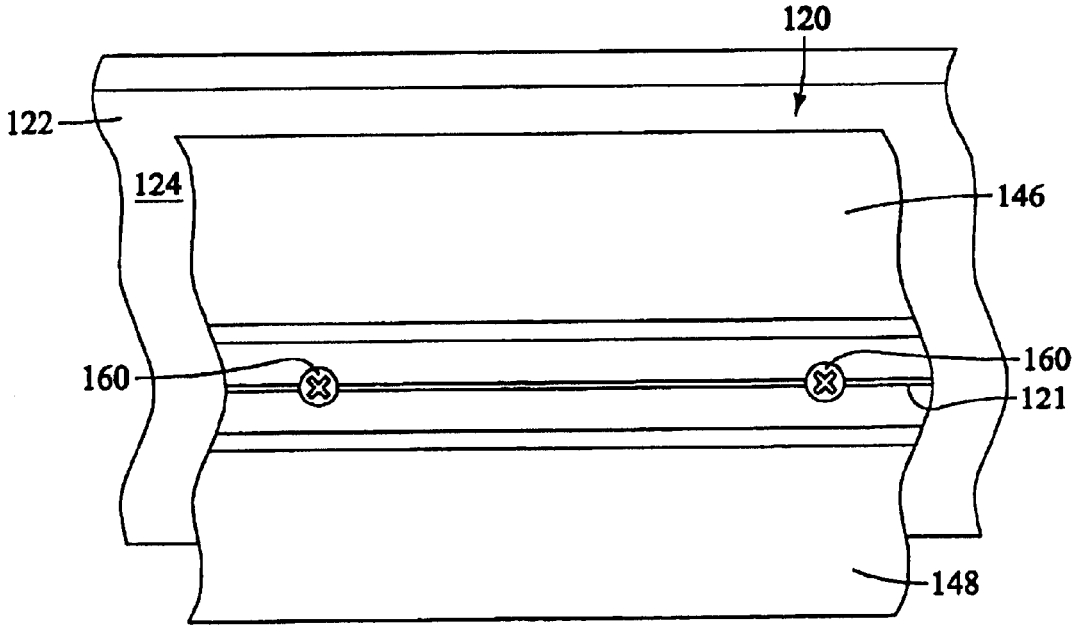
FIG. 7 is a fragmentary, side view of the rub rail of FIG. 6, with the insert removed, illustrating the rub rail being secured with screws to the top deck.

FIG. 7 illustrates rub rail 120 from the side. Rub rail first wing 146 and second wing 148 may be seen, having center insert 150 of FIG. 6 removed. The lack of an upper rub rail lip and the lack of an upper ridge for an upper lip may be seen from inspection of FIGS. 6 and 7. Rub rail center longitudinal mounting region 121 may be seen, having fasteners 160 securing rub rail 120 to top deck 122. Rub rail 120 may be secured to top deck 122 by disposing the rub rail against the top deck, and moving the rub rail 120 upward until lower lip 152 fits snugly against top deck downwardly facing edge 128. Fasteners 160 can then be inserted to fasten rub rail 120 to top deck 122. Center insert 150 can then be inserted to hide fasteners 160, providing a more aesthetically pleasing appearance.

Figure 8:
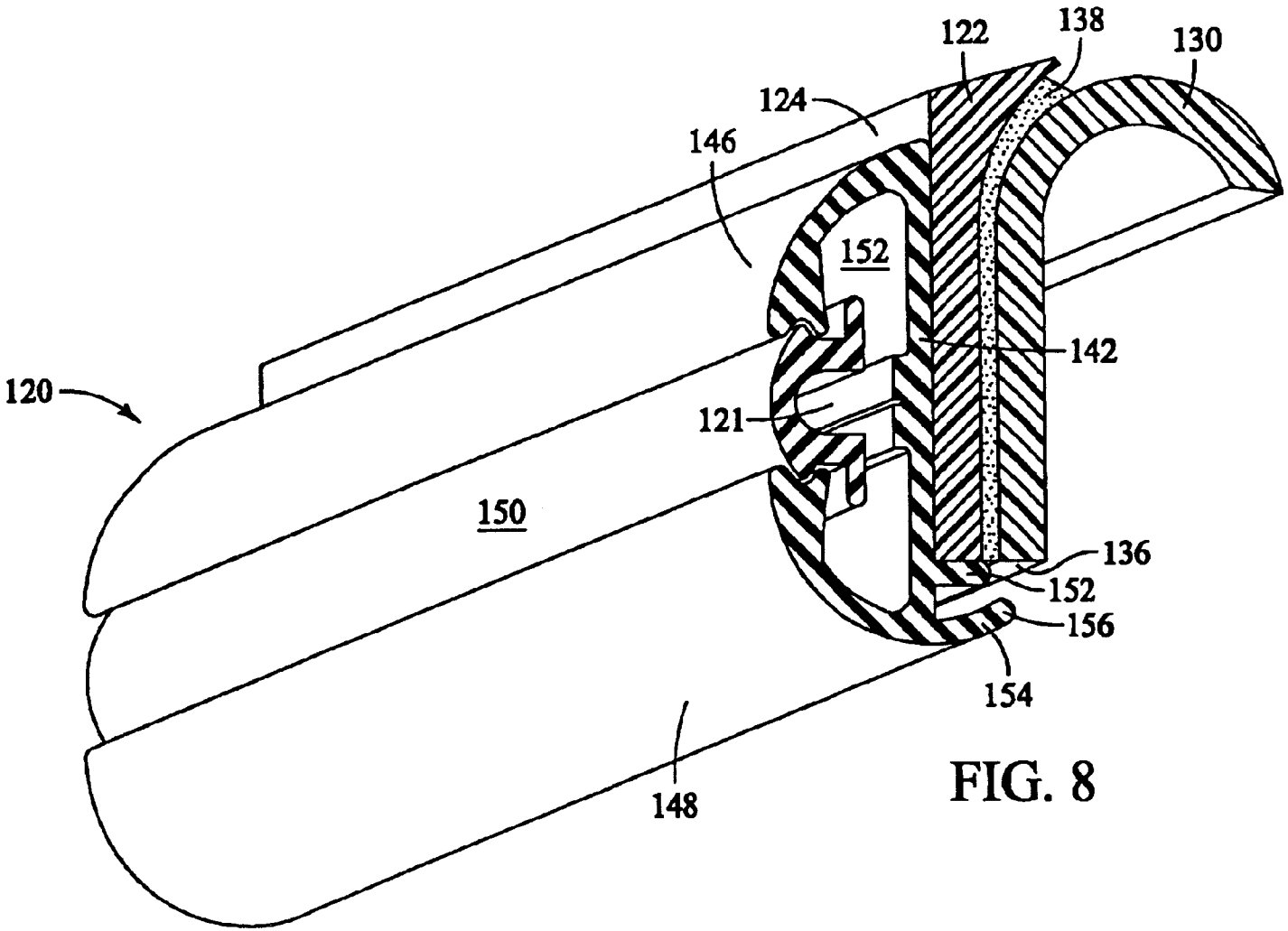
FIG. 8 is a perspective view of the rub rail, top deck, and bottom hull of FIG. 6.

FIG. 8 illustrates rub rail 120, from a bottom, perspective view. All numbered elements are as previously described with respect to FIG. 6. The relationship between the rub rail bottom, inwardly and upwardly curved region 154, top deck 122, and bottom hull 130 may be better viewed in FIG. 8. Rub rail central mounting region 121 of rub rail vertical portion 142 is also better illustrated in FIG. 8.

Figure 9:
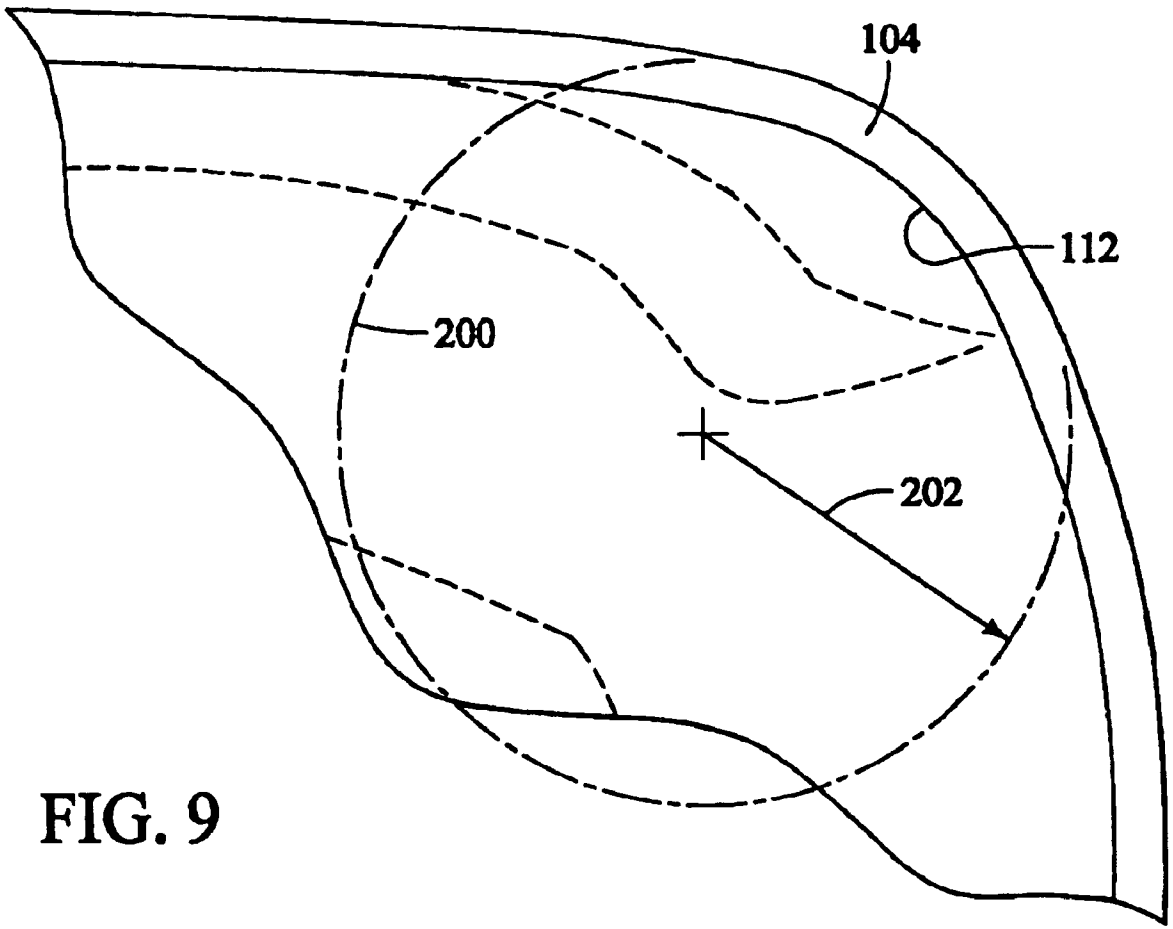
FIG. 9 is a fragmentary, top view of a rear corner of the personal watercraft of FIG. 5, illustrating the rub rail wrapping around a sharp turn having a small radius of curvature.

FIG. 9 illustrates rear corner 112 and rear corner rub rail 104 of FIG. 5, in more detail. Rear corner 112 may be seen to have a circle 200 that can be drawn through the outside surface of the rear corner curve of rub rail 104. The radius of curvature, measured at the outside of the rear corner, is indicated at 202. Using the rub rail provided by the present invention, a rear corner radius of curvature, or horizontal radius of curvature, less than about 16 inches can be protected by the rub rail of the present invention. In other various embodiments, a radius of curvature of less than 12 inches, or less than 10 inches, can be protected by the rub rail being wrapped about the horizontal curve. In one embodiment of the invention, a rear corner having a radius of curvature of about 8 inches is protected by a rub rail wrapped continuously about the rear corner, not requiring a separate, corner bumper. Having the continuous rub rail protecting the rear corners of the watercraft can prevent problems with snagging, previously seen on other personal watercraft. The corner rub rail regions can be made by extrusion, from rigid material, as described below.

Figure 10:
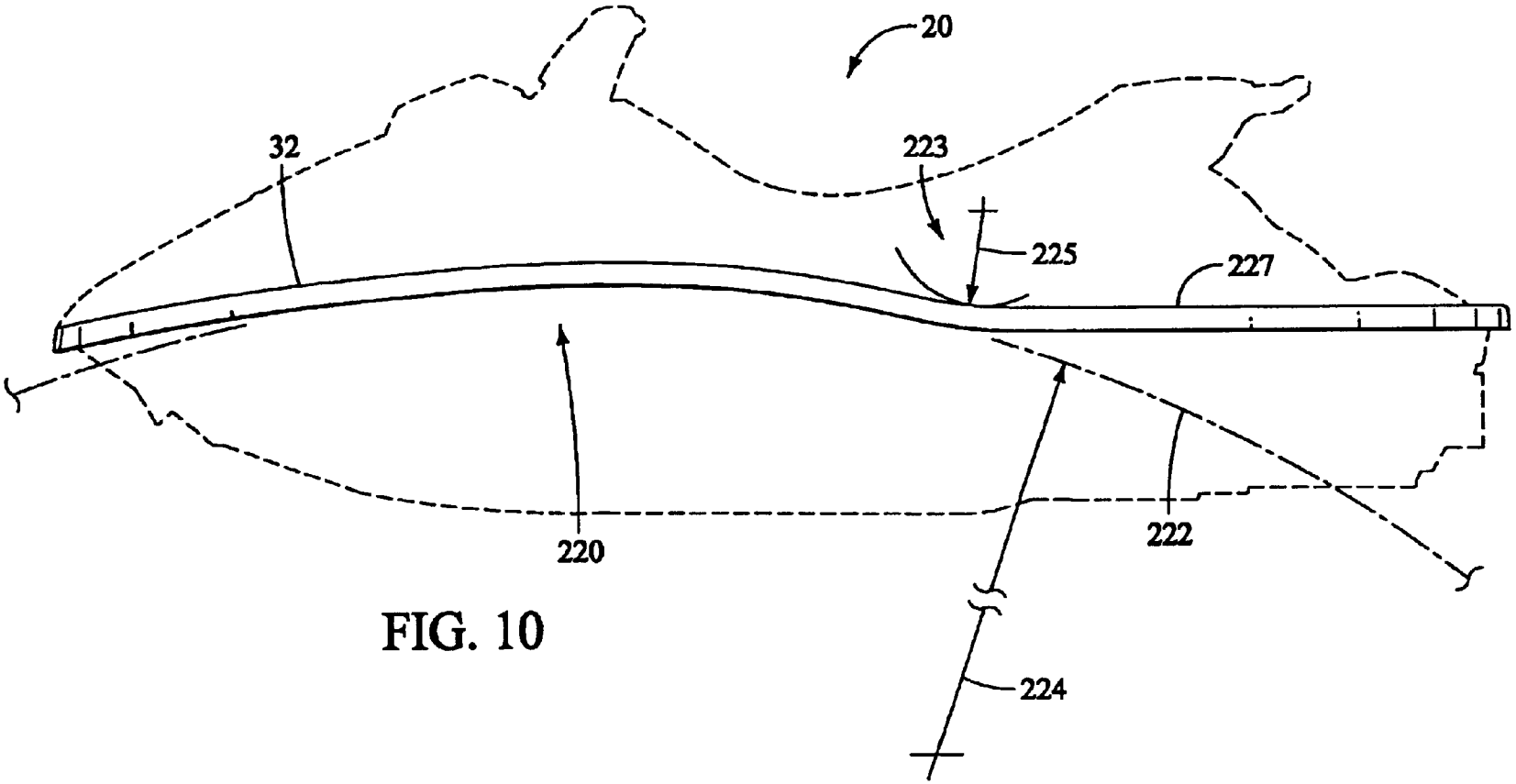
FIG. 10 is a schematic side view of the personal watercraft of FIG. 4, illustrating the rub rail protecting the top deck along a vertical curve having a given radius of curvature.

FIG. 10 illustrates personal watercraft 20 of FIG. 4 having rub rail 32. Personal watercraft 20 may be seen to have a vertically curved rub rail region 220. The vertically curved rub rail region may be seen to be curved vertically within the plane extending through the rub rail vertical back portion. The vertical curvature of rub rail region 220 can thus force the rub rail to curve or bend along the rub rail back portion, previously described. Bending the rub rail back portion in the vertical direction, as opposed to bending or curving the rub rail transverse to the back portion, can present more of a problem. This is due in part because the rub rail back portion is smaller in a lateral thickness dimension than in a top to bottom vertical dimension. A circle 222 may be drawn through the vertically curved rub rail region 220 and can have a vertical radius of curvature as indicated at 224. In some embodiments, the vertical radius of curvature is less than about 20 feet. In other embodiments, the vertical radius of curvature is less than about 15 feet. In one embodiment of the invention, the vertical radius of curvature is about 10 feet.

Rub rail 32 also includes a vertically level rear region 227 proceeding forward to a vertically curved region 223 having a vertical radius of curvature as indicated at 225. In various embodiments, vertically curved region 223 has a vertical radius of curvature of less than 20, 15, and 10 inches, respectively.

The rub rail can be made of any suitable polymeric material, for example, a rigid vinyl or PVC. In various embodiments, the PVC has a Shore A hardness of at least about 90 and/or has a tensile modulus of at least about 2.5 GPa. Some rub rails have a tensile modulus of at least about 0.5 GPa or between about 2.5 and 3 GPa. Other rub rails have a Shore A hardness of at least about 95 and/or a tensile modulus of at least about 1. The rub rail can be manufactured using any well known suitable extrusion technique. The rub rail can be any suitable height and thickness, depending on the watercraft. Some rub rails are about 2 inches in height, having a wall thickness of between about ⅛ and ½ inch.

In preferred embodiments, the rub rails are preformed to match the desired geometry of the watercraft. The rub rail can be formed using an extrusion method to create the desired profile, for example, the cross-section as seen in FIG. 6. A forming jig having substantially the same geometry as the watercraft rear corners or the front, horizontally and vertically curving region, can be made out of any material able to serve as a forming surface or structure. The extrusion can be heated to soften the extrusion, then forced to assume the shape of the forming jig. In one embodiment of the invention, the extrusion and jig are heated together to a temperature of about, or above, the heat deflection temperature of the polymer. The forming jig and the extrusion can then be allowed to cool. After cooling, the now preformed extrusion can be removed from the forming jig, having approximately the shape of the top deck region to which it is to be affixed. In one method, a flexible insert is inserted into the cavity or open channel formed between the wings and the back vertical portion of the extrusion. This insert or mandrel can be used to prevent the wings from collapsing in upon the vertical back side during heating, which would or could, shrink or close the wings to totally remove the open channel. In some methods, the insert is a vinyl, flexible insert. In such methods, the jig, extrusion, and insert or mandrel can be heated together, to maintain the desired internal cavity or open channel of the extrusion. After cooling, the flexible insert or mandrel can be removed.

Inspection of FIGS. 4, 5, and 10, show that rub rail front vertically curved region 220 is also horizontally curved. The simultaneous vertical and horizontal curving is also provided by the preformed rub rail and processes described above.

What is claimed is:

1. A jet-propelled personal watercraft comprising:

a hull including a bottom hull and a top deck secured over the bottom hull, the hull defining an engine compartment sized to contain an internal combustion engine for powering a jet propulsion unit, the jet propulsion unit including a steerable water discharge nozzle, the top deck having a raised, longitudinally extending seat adapted to accommodate an operator in straddle fashion, the top deck having a downwardly extending portion about the watercraft periphery terminating in a bottom edge; and a polymeric rub rail including; a vertical portion secured to the top deck downwardly extending portion and having an inwardly extending lip disposed beneath the top deck bottom edge and further having a bottom curved lip curving upward and inward from the rub rail toward the bottom hull.

2. A personal watercraft as in claim 1, wherein the rub rail has a first wing extending downwardly from the rub rail vertical portion and a second wing extending upwardly from the rub rail vertical portion to form an open channel between the wings and the vertical portion.

3. A personal watercraft as in claim 1, wherein the rub rail is formed of a polymeric material having a Shore A hardness of at least about 90.

4. A personal watercraft as in claim 1, wherein the rub rail is formed of a polymeric material having a Shore A hardness of at least 95.

5. A personal watercraft as in claim 1, wherein the rub rail is secured to the top deck over a region having a vertical radius of curvature of less than about 20 feet.

6. A personal watercraft as in claim 5, wherein the nib rail has a Shore A hardness of at least about 90.

7. A personal watercraft as in claim 1, wherein the rub rail is secured to the top deck over a region having a vertical radius of curvature of less than about 30 feet.

8. A personal watercraft as in claim 7, wherein the rub rail has a Shore A hardness of at least about 90.

9. A personal watercraft as in claim 1, wherein the personal watercraft has two, opposite rear corners, wherein the rub rail wraps continuously around at least one of the corners.

10. A personal watercraft as in claim 9, wherein the rub rail wraps continuously around both rear corners.

11. A personal watercraft as in claim 9, wherein the rub rail includes a first corner piece wrapping continuously around a first corner and a separate second corner piece wrapping continuously around the second corner.

12. A personal watercraft as in claim 9, wherein the corner has a radius of curvature of less than about 2 feet.

13. A personal watercraft as in claim 9, wherein the corner has a radius of curvature of ls than about 1 foot.

14. A personal watercraft as in claim 1, wherein the rub rail has a vertically curved region.

15. A personal watercraft as in claim 14, wherein the rub rail vertically curved region has a radius of curvature of less than about 20 inches.

16. A rub rail for use on a personal watercraft, the rub rail having a longitudinal dimension, a vertical dimension, and a lateral dimension transverse to the longitudinal and vertical dimensions, wherein the rub rail has an inward lateral direction to be disposed toward the watercraft and an outward lateral direction to be disposed away from the watercraft, the rub rail comprising:

a vertical section including an inwardly facing surface for disposition against a personal watercraft peripheral surface, the vertical section having a longitudinally extending mid-region dividing the rub rail into a top region and a bottom region; and a first wing extending outwardly and vertically from the rub rail vertical section;

wherein the rub rail is an extruded rub rail having a Shore A hardness of at least about 90;

wherein the rub rail has a curve along the longitudinal dimension including a vertical curve.

17. A rub rail as in claim 16, wherein the vertical curve has a vertical radius of curvature of legs than about 20 inches.

18. A rub rail as in claim 16, wherein the curve along the longitudinal dimension includes a horizontal curve.

19. A rub rail as in claim 18, wherein the horizontal curve has a horizontal radius of curvature of less than about 2 feet.

20. A rub rail as in claim 16, wherein the rub rail has a Shore A hardness of at least about 95.

21. A rub rail as in claim 16, wherein the rub rail first wing extending outwardly and vertically extends outwardly and downwardly from the vertical section, the tub rail further having a second wing extending, outwardly and upwardly from the rub rail vertical section.

22. A rub rail as in claim 16, wherein the rub rail has a first lip extending inwardly from the vertical section, and a second lip curving upwardly and inwardly from the vertical section.

23. A rub rail as in claim 16, wherein the rub rail comprises PVC.

24. A rub rail as in claim 16, wherein the rub rail comprises PVC having a tensile modulus of at least about 2 GPa.

25. A rub rail for mounting on a personal watercraft, the rub rail comprising:

a longitudinal dimension;

a vertical dimension;

a lateral dimension transverse to the longitudinal and vertical dimensions;

an inward lateral direction to the toward the watercraft;

an outward lateral direction to be away from the watercraft;

wherein the rub rail includes a transverse, integrally formed cross-sectional profile that includes a substantially vertical back section and at least one wing extending outwardly and vertically from the back section;

wherein the rub rail is formed from a rigid material having a tensile modulus of at least about 2 GPa; and a curve along the longitudinal dimension including a vertical curve.

26. A rub rail as in claim 25, wherein the curve includes a horizontal curve.

27. A rub rail as in claim 25, wherein the curve is a vertical and horizontal curve.

* * * * *